US009362656B2

(12) United States Patent
Singhammer et al.

(10) Patent No.: US 9,362,656 B2
(45) Date of Patent: Jun. 7, 2016

(54) INSERTION-TYPE CONNECTOR HAVING AN INSULATING PART

(71) Applicant: ROSENBERGER HOCHFREQUENZTECHNIK GMBH & CO. KG, Fridolfing (DE)

(72) Inventors: Martin Singhammer, Fridolfing (DE); Martin Zebhauser, Laufen (DE); Till Bredbeck, Traunstein (DE); Michael Müller, Quirla (DE)

(73) Assignee: Rosenberger Hochfrequenztechnik GmbH and Co. KG, Fridolfing (DE)

( * ) Notice: Subject to any disclaimer, the term of this patent is extended or adjusted under 35 U.S.C. 154(b) by 0 days.

(21) Appl. No.: 14/439,314

(22) PCT Filed: Aug. 22, 2013

(86) PCT No.: PCT/EP2013/002568

§ 371 (c)(1),
(2) Date: Apr. 29, 2015

(87) PCT Pub. No.: WO2014/067595

PCT Pub. Date: May 8, 2014

(65) Prior Publication Data

US 2015/0303606 A1 Oct. 22, 2015

(30) Foreign Application Priority Data

Oct. 30, 2012 (DE) ..... 20 2012 010 451 U

(51) Int. Cl.

| | |
|---|---|
| ***H01R 13/502*** | (2006.01) |
| ***H01R 13/447*** | (2006.01) |
| ***H01R 13/648*** | (2006.01) |
| ***H01R 13/516*** | (2006.01) |

(52) U.S. Cl.

CPC ..... *H01R 13/447* (2013.01); *H01R 13/502* (2013.01); *H01R 13/516* (2013.01); *H01R 13/648* (2013.01)

(58) Field of Classification Search

CPC .. H01R 2107/00; H01R 24/60; H01R 13/502; H01R 13/6335; H01R 12/57

See application file for complete search history.

(56) References Cited

U.S. PATENT DOCUMENTS

| | | | | |
|---|---|---|---|---|
| 5,951,326 | A | 9/1999 | Okabe | |
| 7,661,986 | B2 * | 2/2010 | Maesoba | H01R 13/4223 439/595 |
| 7,699,672 | B2 * | 4/2010 | Zaderej | H01P 1/04 29/883 |
| 7,736,191 | B1 * | 6/2010 | Sochor | A61N 1/3752 439/668 |
| 7,828,604 | B1 * | 11/2010 | Lai | H01R 13/64 439/607.4 |
| 7,901,251 | B1 * | 3/2011 | Chen | H01R 13/7032 439/668 |
| 8,033,848 | B2 * | 10/2011 | Khemakhem | H01R 13/518 439/188 |
| 8,038,457 | B2 * | 10/2011 | Hughes | H01H 33/66207 439/181 |
| 8,360,792 | B2 * | 1/2013 | Khemakhem | H01R 13/518 439/188 |
| 8,439,691 | B1 * | 5/2013 | Lan | H01R 12/724 439/660 |
| 2009/0280700 | A1 | 11/2009 | Sogo et al. | |

FOREIGN PATENT DOCUMENTS

| | | | |
|---|---|---|---|
| DE | 10 2010 039314 | A1 | 2/2012 |
| EP | 1843435 | A2 | 10/2007 |

* cited by examiner

*Primary Examiner* — Truc Nguyen

(74) *Attorney, Agent, or Firm* — DeLio, Peterson & Curcio, LLC; Robert Curcio

(57) ABSTRACT

An insulating part for a plug connector having a base with a bore for receiving an internal conductor of the plug connector, and an aperture which opens in radial direction into the bore, via which the internal conductor can be inserted into the bore, wherein a cover connected to the main body is provided, which in a first position releases the aperture and in a second position covers the aperture.

11 Claims, 3 Drawing Sheets

INSERTION-TYPE CONNECTOR HAVING AN INSULATING PART

BACKGROUND OF THE INVENTION

1. Field of the Invention

The invention relates to an insertion-type connector having an insulating part which forms one or more bores to receive a corresponding number of inner conductors. The insulating part holds the inner conductors in an electrically insulated state within an outer conductor of the insertion-type connector.

2. Description of Related Art

An insertion-type connector of the generic kind is described in EP 1 825 575 B1. The insulating part of the insertion-type connector has a stellate cross-section and forms a total of four bores arranged in a square, each of which is intended to receive an inner conductor. The inner conductors are each introduced into the associated bore via a radial slot and are fixed in it by positive and frictional engagement. The insulating part, which is formed from an electrically insulating material, ensures that the inner conductors are durably positioned at a distance from an outer conductor which entirely surrounds the insulating part, with air acting as a dielectric in the radial slots.

The insertion-type connector has one end which is intended for connection to a complementary insertion-type connector. The other end is intended for connection to a cable. The corresponding ends of the inner conductors at the cable end have two tabs which are bent over to make a crimped connection to the corresponding inner conductors of the cable. When this is done, it may happen that not all the individual wires of the inner conductors are clamped between the tabs and thus extend into the radial slots in the insulating part. This may cause a short-circuit if the individual wires come into contact with the outer conductor of the insertion-type connector.

SUMMARY OF THE INVENTION

Taking the above prior art as a point of departure, the object underlying the invention was to specify an insertion-type connector in which the risk which has been described of a short-circuit due to contact between an inner conductor and outer conductor is avoided.

This object is achieved by an insulating part and an insertion-type connector as defined in the specification herein and in the claims. Advantageous embodiments thereof can be seen from the claims and from the following description of the invention.

The above and other objects, which will be apparent to those skilled in the art, are achieved in the present invention which is directed to an insertion-type connector comprising: at least one inner conductor; one outer conductor; one insulating part including a main body having a bore to receive the inner conductor and having an opening which opens into the bore in the radial direction, via which opening the inner conductor can be introduced into the bore; and a cover connected to the main body, which leaves the opening open in a first position and covers up the opening in a second position and which is movable from the first position to the second on an axis of pivot which extends in the direction defined by the longitudinal axis of the bore, the outer conductor having an assembly opening through which the insulating part can be introduced into it, the arrangement of the assembly opening and the cover being such that the cover is moved to the second position by the introduction of the insulating part into the outer conductor.

The cover may be connected to the main body in one piece.

The cover includes at least a local deformation, wherein the connector is produced with the cover in the first position, and the movement of the cover to the second position involves the at least local deformation of the cover.

The connector includes at least two bores extending in parallel, with the openings which open into the bores extending to two sides of the main body, and with the two sides of the main body each having a cover associated with them. The two sides of the main body may be formed to have mirror-image symmetry.

The outer conductor may include a U-shaped cross-section in a region of the cover.

The insertion-type connector has a longitudinal axis connecting an insertion end and a cable end, the assembly opening in the outer conductor being so arranged that the insulating part can be brought into the outer conductor by a movement in the direction in which the longitudinal axis is aligned at the insertion end.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
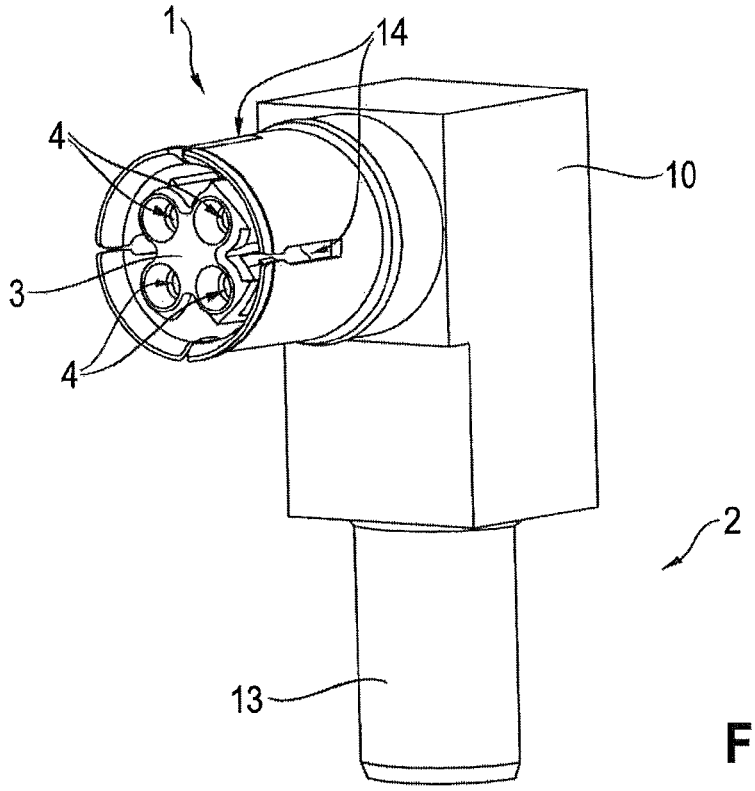
FIG. 1 is a first perspective view of an insertion-type connector according to the invention.

In describing the preferred embodiment of the present invention, reference will be made herein to FIGS. 1-6 of the drawings in which like numerals refer to like features of the invention.

An insulating part for an insertion-type connector comprises a main body having a (or at least one) bore (which, in accordance with the invention, is not confined to stock-removing production by, for example, drilling) to receive an (or at least one) inner conductor of the insertion-type connector and having an (or at least one) opening which opens into the bore in the radial direction (relative to a longitudinal axis of the bore), via which opening the inner conductor can be introduced into the bore, and is characterized in accordance with the invention by a cover, connected to the main body, which leaves the opening open in a first position and covers up the opening in a second position.

By the cover, any contact between the inner conductor (and in particular individual wires thereof) of the insertion-type connector or of a cable connected thereto and an outer conductor of the insertion-type connector is reliably prevented. Because the cover leaves the opening open in its first position, it does not hamper any introduction of the inner conductor into the insulating part during assembly.

An insertion-type connector according to the invention of this kind comprises an (or at least one) insulating part according to the invention, a (or at least one) inner conductor, and a (or at least one) outer conductor.

In a preferred embodiment of insulating part according to the invention, provision may be made for the cover to be connected to the main body in one piece. An insulating part of this kind can for example be easily and inexpensively produced from (electrically insulating) plastics material in the form of an injection molding.

As a particular preference, provision may be made in this case for the insulating part to be produced in such a way that the cover is in the first position on being produced. Provision may then be made for at least local deformation of the cover to move said cover to the second position. This local deformation may also be assisted in this case by making the cover, or rather the transition from the cover to the main body, of a weakened form along an intended line of deformation. In particular, a film hinge may be formed along this line of deformation.

The movement of the cover from the first position to the second preferably takes place on an axis of pivot (which may in particular correspond to the line of deformation) which extends in the direction defined by the longitudinal axis of the bore. What is meant by "in the direction defined by" in this case is that the axis of pivot makes an angle of less than 90° and preferably of less than 45° with the longitudinal axis. As a particular preference the axis of pivot extends parallel to or co-axially with the longitudinal axis of the bore. Amongst other things, this enables the opening which opens into the bore to take the form of a longitudinal opening, which likewise preferably extends parallel to the longitudinal axis of the bore. The longitudinal opening then makes it possible for the inner conductor to be introduced into the bore from the side at the same time along its entire length, in particular by a movement in translation, when the insertion-type connector is being assembled.

In a preferred embodiment of insertion-type connector according to the invention, provision may be made for the cover to be moved automatically to the second position, in which second position it covers up the opening, when the insertion-type connector is being assembled, i.e., when the insulating part is introduced into the outer conductor. For this purpose, the outer conductor may have an assembly opening through which the insulating part can be introduced into it, the arrangement of the assembly opening and the cover being such that the cover is moved to the second position by the introduction of the insulating part into the outer conductor.

The introduction of the insulating part into the outer conductor may preferably take place from the side in this case (relative to a longitudinal axis of the insertion-type connector in the region of the cover). For this purpose, the outer conductor of the insertion-type connector according to the invention may for example be of a U-shaped cross-section in (at least) that region in which it receives the cover belonging to the insulating part.

A cross-sectional shape of this kind for the outer conductor may, amongst other things, be advantageously combined with an insulating part which has at least two, and preferably four, bores extending in parallel (for a corresponding number of inner conductors), with the openings which open into the bores extending to two sides of the main body and with the two sides of the main body each having a cover associated with them. The two sides of the main body may preferably be formed in this case to have mirror-image symmetry, thus enabling a double-E shaped cross-section (i.e., one having a central longitudinal web and three transverse webs preferably intersecting the central web perpendicularly, with one of these arranged at the center of the longitudinal web and two arranged at its ends) to be produced for the main body of the insulating part. The two covers (which, in the case of a double-E shaped cross-sectional shape, may preferably be arranged at the free ends of an outer transverse web) can then be moved to their respective second positions when being inserted in the outer conductor by making contact with the outer limbs of the outer conductor, which latter is U-shaped in cross-section.

The insertion-type connector according to the invention may have an insertion end and a cable end, with the longitudinal direction of the insertion-type connector and hence its longitudinal axis being defined by connecting these ends. Provision may then preferably be made for the assembly opening in the outer conductor to be so arranged that the insulating part can be introduced into the outer conductor by a movement in the direction in which the longitudinal axis is aligned at the insertion end. This enables a configuration to be possible for the insertion-type connector in which the outer conductor is of a completely closed form in the region of the insertion end. This may be advantageous particularly when the outer conductor is intended to serve in this region as the insertion-type element in socket form of an insertion-type connection made to a complementary mating insertion-type connector (or to the outer conductor thereof).

In an insertion-type connector which is designed as an angled insertion-type connector having a longitudinal axis which is angled (preferably at 90°), provision may be made for that portion of the insulating part which has the cover(s) to be introduced from the side into the outer conductor, which is preferably of a U-shaped form at this point, when the cover or covers is/are provided in the region of the cable end, where it is/they are particularly advantageous due to the inner conductor or conductor being connected, by crimping for example, to an inner conductor or conductors of a cable, which latter regularly consist of individual wires.

In the case of a straight insertion-type connector on the other hand, the forced movement of the cover(s) from the first position to the second can be achieved by arranging the axis (axes) of pivot of the cover(s) to be oblique to the direction in which the insulating part moves when being introduced into the outer conductor and/or by having them slide over a suitably obliquely aligned edge(s) or surface(s) of the outer conductor.

The insertion-type connector shown in the drawings takes the form of an angled insertion-type connector. It comprises an insertion end as part of an insertion-end portion 1 which is designed to make a plug-in connection to a complementary mating insertion-type connector (not shown). The insertion-type connector also comprises a cable end as part of a cable-end portion 2 which is intended for the connecting-in of a cable (not shown). The insertion-end portion 1 and the cable-end portion 2 are at an angle of 90° to one another. The longitudinal axis which connects the insertion end to the cable end therefore likewise follows a path which is angled at 90°.

The insertion-type connector comprises an insulating part which is formed in one piece. The latter takes the form of an injection molding made of an electrically insulating plastics material. A main body 3 of the insulating part is of an angled configuration which follows that of the insertion-type connector and it forms a plurality of bores 4 (four in all) which extend for the entire length of the insulating part—in a more or less enclosed form and with an interruption in the region of the angle (the bores may thus even comprise part-bores which are spaced away from one another). In cross-section, the bores 4 are laid out in a square within the main body 3. This corresponds to the usual layout of the four inner conductors which are used in high speed data (HSD) insertion-type connectors. An insertion-type connector according to the invention may be particularly intended as an HSD connector.

In the cable-end portion 2 of the insulating part the bores 4 are of a form which is enclosed over more than 180° and they each merge radially into a slotted opening 5. In a part of the insertion-end portion 1 of the insulating part, the bores 4 are of a corresponding configuration. The bores 4 are only completely enclosed in the region of the insertion end of the insulating part.

Over the entire length (except at the insertion end of the insulating part), an inner conductor 6 can be introduced into each of the bores 4 from the side, through the lateral openings of the bores 4. Because the length of the inner conductors 6 is shorter than that of the insulating part, the completely enclosed form taken by the bores 4 at the insertion end of the insulating part does not hamper this introduction.

The inner conductors 6 are held in the bores 4 by positive engagement in that a sort of snap-in connection is made in the insertion-end portion 1 of the insulating part between said inner conductors 6 and retaining portions 7 of the bores. For this purpose, the width of a given slotted opening 5 at the transition to the retaining portions 7 of the individual bores 4 is somewhat smaller than the diameter of the associated portion of the given inner conductor 6. The inner conductor 6 itself and/or the retaining portions of the insulating part are thus temporarily deformed elastically when the inner conductors 6 are being introduced.

The individual inner conductors 6 take the form of stamped, punched or die-cut, and bent, parts made of electrically conductive sheet metal. In their insertion-end portions 1 the inner conductors 6 are bent round in such a way that they are of an (almost) closed tubular form (which is circular in cross-section). As a result, they may advantageously act as insertion-type elements in socket form of the insertion-type connector, in which insertion-type elements in pin form of inner conductors of a complementary insertion-type connector can be inserted. At the angle in the insertion-type connector, the inner conductors 6 take the form of simple strips. As a result, they can be bent satisfactorily into a curved configuration which follows the angle. In the cable-end portions 2, the inner conductors 6 form two (almost) closed tubular portions 8, 9 arranged one behind the other. The first tubular portion 8 of each inner conductor 6 (counting from the strip of a curved configuration) is of as circular a cross-section as possible and thereby ensures that the inner conductor 6 is seated largely free of any play in the corresponding portion of the associated bore 4 in the insulating part. If required, the making of a snap-in connection, corresponding to that at the retaining portion 7 of the insertion-end portion 1 of the insulating part, may be designed at this point too. Those strips of the respective inner conductors 6 which form the second tubular portions 9 on the other hand are more sharply curved. They can thus easily be further bent to allow a crimped connection to be made to the inner conductors of a cable (not shown), which inner conductors consist of individual wires.

When the crimped connection is made, it may happen that some of the individual wires are not taken hold of and are thus arranged outside the second portions 9 of the inner conductors 6 of the insertion-type connector. To stop there from being any contact by these individual wires with an outer conductor 10 surrounding the insulating part, the insulating part has two covers 11 in flap form which are connected to the main body 3 in one piece and which, when the insertion-type connector is in the assembled state, cover up the slotted openings 5 in the corresponding portions, which open into the bores 4.

Figure 5:
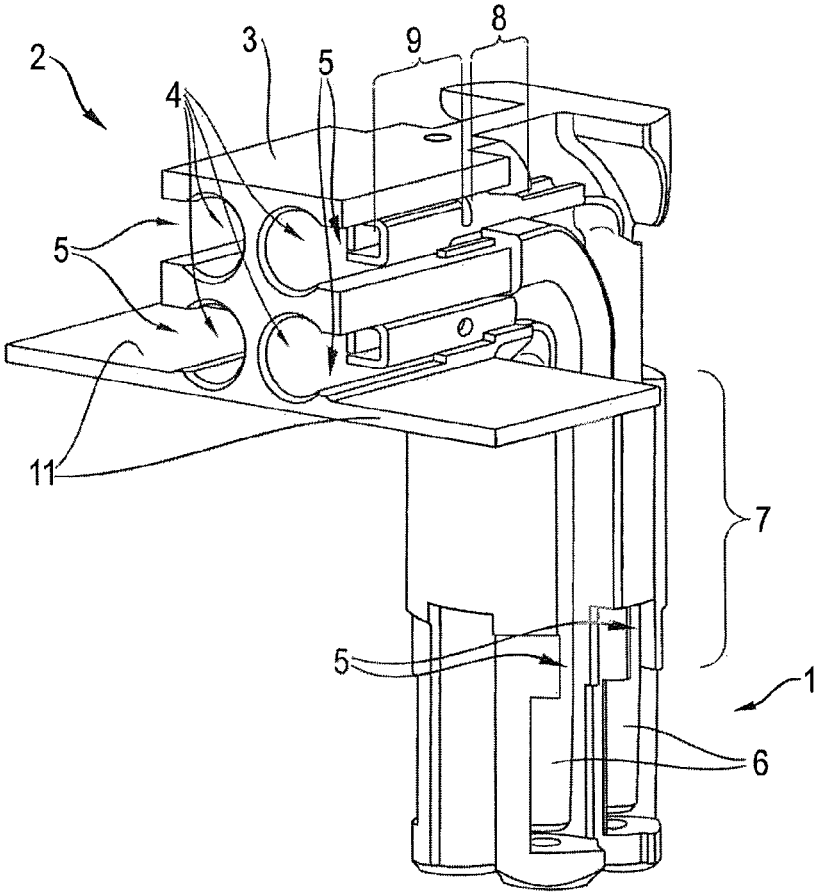
FIG. 5 is a perspective view of the inner conductors and the insulating part of the insertion-type connector showing the covers in their first position.
Figure 6:
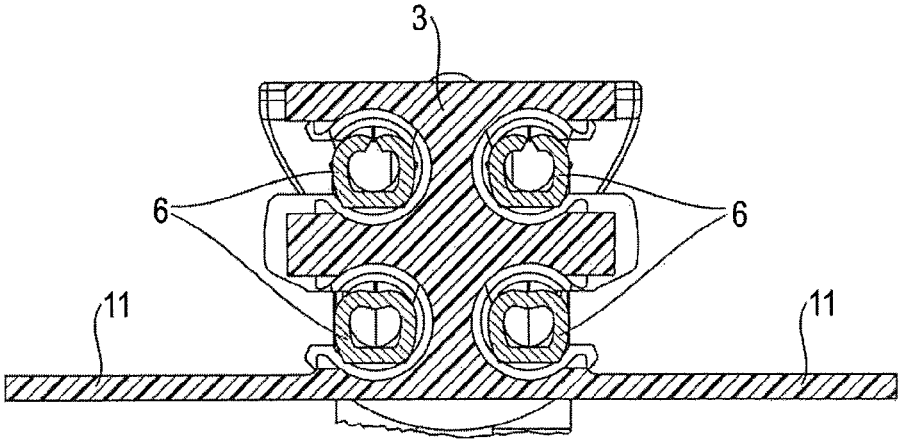
FIG. 6 is a cross-section through the cable ends of the insulating part and the inner conductors showing the covers in the first position.

FIGS. 5 and 6 show the covers 11 in a first position in which they do not cover up the slotted openings 5. The insulating part is produced with the covers 11 in this position.

Figure 2:
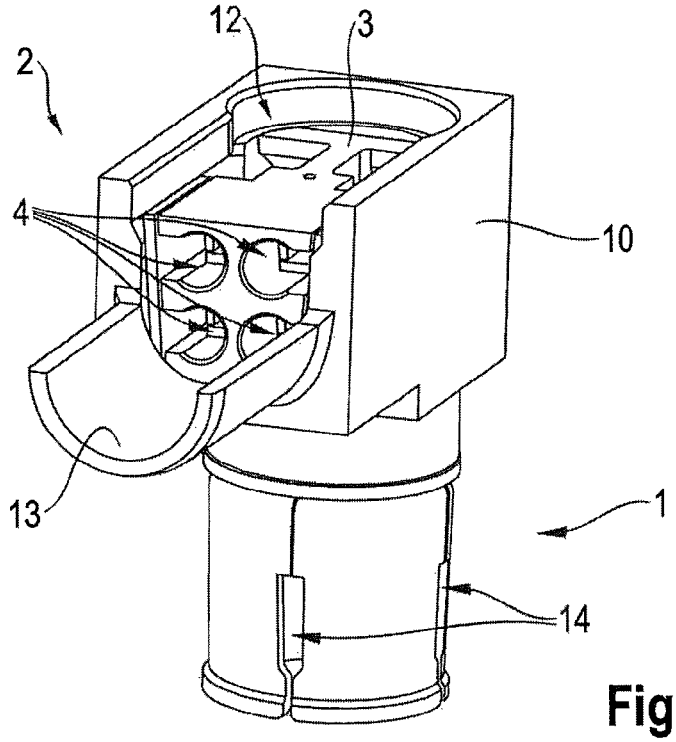
FIG. 2 is a second perspective view of the insertion-type connector.
Figure 3:
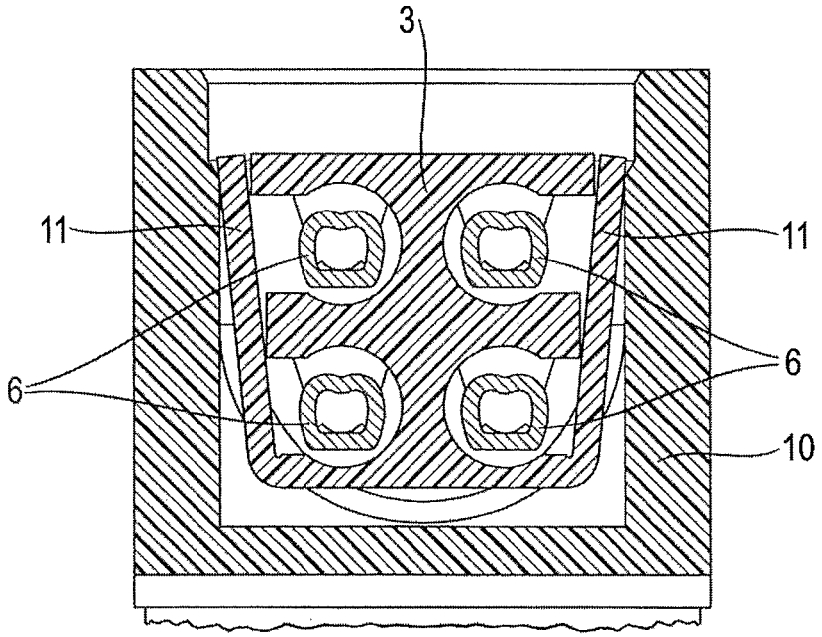
FIG. 3 is a cross-section through the cable end of the insertion-type connector.
Figure 4:
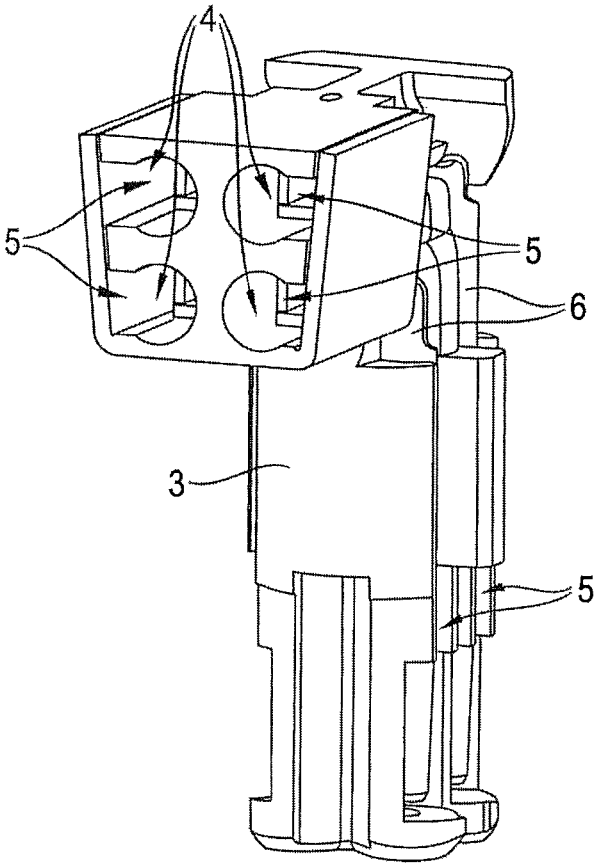
FIG. 4 is a perspective view of the inner conductors and the insulating part of the insertion-type connector showing the covers in their second position.

When the insertion-type connector is assembled on the other hand, the covers are pivoted to the second position shown in FIGS. 2 to 4, which involves a local deformation of the covers 11 along lines of deformation which, at the transitions from the covers 11 to the main body 3, extend parallel to the longitudinal axis of the insertion-type connector as it exists in this region. This deformation may be of an elastic and/or plastic nature. In the second position, the slotted openings 5 are covered up by the covers 11, whereby individual wires which are not taken hold of by the crimped connections are prevented from making contact with the outer conductor 10.

To assemble the insertion-type connector, the inner conductors 6 are first introduced into the bores 4 in the insulating part and the resulting unit is then pressed into the outer conductor 10. This pressing-in takes place in the direction defined by the longitudinal axis of the insertion-type connector in the insertion-end portion 1. For this purpose, the opposite end of the outer conductor 10 from the insertion end is provided with a suitable assembly opening 12. Because the insertion-type connector is angled, the introduction of the unit comprising the insulating part and the inner conductors 6 takes place at the side in the cable-end portion 2. When this is done, the covers 11, which are still in the first position, butt against the edge-faces of the outer limbs of the outer conductor 10, of which this portion has been given a U-shaped cross-section, and are thereby forced to the second position. The covering-over of the slotted openings 5 in the relevant portion of the insulating part thus takes place automatically as a result of the introduction of the latter into the outer conductor 10. Hence it does not involve any additional cost or complication at assembly.

In the portion of the main body 3 in which it is connected to the covers 11, it is of a double-E shaped cross-section, i.e., this double-E shaped cross-section is formed by a central longitudinal web and three transverse webs, of which latter one intersects the longitudinal web its center and the other two intersect it at its ends. The covers 11 are connected at the sides to one of the outer transverse webs. The pivoting of the covers takes place through almost 90°. After the pivoting, the covers 11 rest against the central transverse web and the other of the outer transverse webs.

After the introduction of the unit comprising the insulating part and the inner conductors 6 into the outer conductor 10, the assembly opening 12 in the outer conductor is closed off by a fitted cap (not shown). This cap also comprises the second half of a tubular connecting piece 13 of the outer conductor 10, which is intended to enclose an outer conductor of the cable on the outside, whereby the electrical connection is made to the outer conductor of the insertion-type connector.

Also, the connecting piece 13 improves the strength of the connection between the cable and the insertion-type connector.

In the insertion-end portion 1, the outer conductor 10, which is made of electrically conductive material, is in the form of an insertion-type element in socket form into which a corresponding insertion-type element of the complementary mating insertion-type connector can be plugged. Longitudinal slots 14 make good radial elasticity possible when this is done.

Rather than a solid outer conductor which forms a housing of the insertion-type connector at the same time, as envisaged in the present embodiment, it is of course also possible for an outer conductor arranged in a housing, preferably an electrically insulating one, to be used.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insertion-type connector comprising:

at least one inner conductor;

one outer conductor;

one insulating part including a main body having a bore to receive the inner conductor and having an opening which opens into the bore in a radial direction, via which opening the inner conductor can be introduced into the bore; and a cover, connected to the main body, which leaves the opening open in a first position and covers up the opening in a second position and which is movable from a first position to a second position on an axis of pivot which extends in a direction defined by a longitudinal axis of the bore, the outer conductor having an assembly opening through which the insulating part can be introduced into it, an arrangement of the assembly opening and the cover being such that the cover is moved to the second position by the introduction of the insulating part into the outer conductor.

2. The insertion-type connector of claim 1, wherein the cover is connected to the main body in one piece.

3. The insertion-type connector of claim 1, including at least a local deformation in said cover, wherein said connector is produced with the cover in the first position, and the movement of the cover to the second position involves said at least local deformation of the cover.

4. The insertion-type connector of claim 1, including at least two bores extending in parallel, with the openings which open into the bores extending to two sides of the main body, and with the two sides of the main body each having a cover associated with them.

5. The insertion-type connector of claim 1, wherein the two sides of the main body are formed to have mirror-image symmetry.

6. The insertion-type connector of claim 1, wherein the outer conductor includes a U-shaped cross-section in a region of the cover.

7. The insertion-type connector of claim 1, having a longitudinal axis connecting an insertion end and a cable end, the assembly opening in the outer conductor being so arranged that the insulating part can be brought into the outer conductor by a movement in the direction in which the longitudinal axis is aligned at the insertion end.

8. The insertion-type connector of claim 2 including at least a local deformation in said cover, wherein said connector is produced with the cover in the first position, and the movement of the cover to the second position involves said at least local deformation of the cover.

9. The insertion-type connector of claim 8, including at least two bores extending in parallel, with the openings which open into the bores extending to two sides of the main body, and with the two sides of the main body each having a cover associated with them.

10. The insertion-type connector of claim 9, wherein the outer conductor includes a U-shaped cross-section in a region of the cover.

11. The insertion-type connector of claim 10, having a longitudinal axis connecting an insertion end and a cable end, the assembly opening in the outer conductor being so arranged that the insulating part can be brought into the outer conductor by a movement in the direction in which the longitudinal axis is aligned at the insertion end.

* * * * *